US005387159A

United States Patent [19]

Hilgert et al.

[11] Patent Number: 5,387,159

[45] Date of Patent: Feb. 7, 1995

[54] CONTINUOUS WAVE GENERATING APPARATUS FOR SIMULATED SURFRIDING

[76] Inventors: Rick L. Hilgert, 1501 Haven Pl., Newport Beach, Calif. 92663; Raymond G. Simpson, 983 Paularino Ave., Costa Mesa, Calif. 92626

[21] Appl. No.: 113,243

[22] Filed: Aug. 30, 1993

[51] Int. Cl.[6] ..... A63G 31/02

[52] U.S. Cl. ..... 472/128; 472/90; 472/91; 405/79

[58] Field of Search ..... 472/88, 90, 91, 128, 472/129, 137, 117; 405/79; 4/491; 482/51; 434/126

[56] References Cited

U.S. PATENT DOCUMENTS

| | | | |
|---|---|---|---|
| 883,485 | 3/1908 | Ridgway | 472/137 |
| 3,536,324 | 10/1970 | Ahrens | 472/137 |
| 3,613,264 | 10/1971 | Vitka et al. | 434/126 |
| 3,802,697 | 4/1974 | Le Mehante | 472/128 |
| 3,913,332 | 10/1975 | Forsman | 4/491 |
| 3,981,612 | 9/1976 | Bunger et al. | 4/491 |
| 4,564,190 | 1/1986 | Frenzl | 472/128 |
| 4,792,260 | 12/1988 | Sauerbier | 405/79 |
| 5,171,101 | 12/1992 | Sauerbier et al. | 405/79 |

FOREIGN PATENT DOCUMENTS

| | | | |
|---|---|---|---|
| 26372 | of 1913 | United Kingdom | 472/137 |

*Primary Examiner*—Carl D. Friedman
*Assistant Examiner*—Kien Nguyen
*Attorney, Agent, or Firm*—Francis X. LoJacono

[57] ABSTRACT

A wave-generating apparatus that is used for various types of surfriding water sports, such as body-surfing, boogie-boarding, and belly-boarding and is defined by a horizontally positioned, rotatable, cylindrical housing cradled in a frame structure, wherein a suitable amount of water is contained within the housing by means of end caps member that define a reservoir within the cylindrical housing, whereby a continuous wave pattern is formed in the stored water as the tube is rotated about its horizontal axis.

9 Claims, 2 Drawing Sheets

CONTINUOUS WAVE GENERATING APPARATUS FOR SIMULATED SURFRIDING

BACKGROUND OF THE INVENTION

1. Field of the Invention

The invention relates to a wave generating apparatus and more particularly to a wave generating apparatus used for various types of water sports such as surfriding and body surfing that is defined by a horizontally positioned rotatable tube in which a suitable amount of water is contained to form a continuous wave pattern as the tube is rotated about its axis.

2. Description of the Prior Art

As is well known in the art, various types of wave generating apparatuses have been suggested and tried. However, most of these apparatuses have features that restrict their use and they are very expensive to build or manufacture. The basic structures and methods of such devices generally require large bodies of water having a variety of wave forming mechanisms which are located in or below the water line. Most wave forming mechanisms are designed to move either along an elongated longitudinal path in a horizontal plane or in a continuous circular bath in a horizontal plane. Both arrangements require a great deal of open space to accommodate the large body of water that is needed and for the long distances required for the mechanisms to generate a proper and useful wave for body surfing or other types of surfriding such as surfboarding or tube riding.

As examples of known wave forming apparatuses attention is directed to the following United States patents.

U.S. Pat. No. 3,802,697 to Bernard J. Le Mehaute discloses a wave generator for simulated surfriding that includes a water-filled channel and a wave-forming body positioned in the channel so that water is deflected by the upper surface of the body for simulation to a rider of a boat or surfboard attached to the wave forming body. The wave forming body is either movable or stationary as long as movement exists relative to the water.

U.S. Pat. No. 3,913,332 to Arnold H. Forsman discloses a continuous wave-surfing facility having a body of water and wave generator for producing a continuous wave suitable for surfing. A plurality of generators provides serial waves on opposite sides of a tunnel structure having screen grills for preventing surfers from colliding with the wave generators. Both double-bladed and alternatively single-bladed wave generators are provided.

U.S. Pat. No. 3,981,612 to Charles Bunger et al discloses a wave-producing apparatus for simulating surfing, skateboard riding, and the like, including a flexible elongated web and carriage means upwardly flexing the web and movable longitudinally thereof to produce a traveling wave.

U.S. Pat. No. 4,564,190 to Otto Frenzl discloses an appliance for practicing aquatic sports using gliding devices supported atop a turbulent, nonseparated flow of water.

U.S. Pat. No. 4,792,260, to Charles E. Sauerbier discloses a wave-forming generator for generating surfing waves of the tunnel-wave type on the surface of a body of water. The generator includes a generator hull which is partially submerged in the water, and a means for propelling the hull through the water in a direction of motion.

U.S. Pat. No. 5,171,101 to Charles E. Sauerbier, et al, discloses a wave-forming generator for generating inclined surfaces on a contained body of water. The water is propelled against the surface-shaping generator with sufficient force to impart the desired shape to the water surface, and the generated surfaces can include waves appropriate for surfing.

In U.S. Pat. No. 883,485 to H. N. Ridgway there is disclosed am amusement apparatus that comprises a horizontally arranged cylinder having unobstructed open ends. The cylinder is freely supported on rolls in such a way that it can freely rotate in either direction about its axis.

In U. S. Pat. No. 3,536,324 to C. W. Ahrens there is disclosed a roller and track assembly for rotatably supporting a playground tread barrel for free rotation about its longitudinal axis while holding the barrel against removal from a base frame on which the rollers of the assemblies are mounted. This apparatus is very similar in structure and use as is disclosed in U.S. Pat. No. 883,485.

SUMMARY AND OBJECTS OF THE INVENTION

The present invention comprises an elongated rotatable cylinder having an enlarged diameter defining a tube of between 12 to 25 feet in length. Each end of the cylinder is provided with an annular wall member or other suitable means in order to partially close the ends, whereby a sufficient amount of water can be contained therein during the rotation of the cylinder about its axis. The cylinder is cradled in a carriage support comprising a frame structure that includes a plurality of wheels mounted to the frame structure. At least one set of wheels is arranged to drive the cylinder in either a counter-clockwise or clockwise rotation at a suitable speed so as to establish a proper centrifugal force to cause the water to be contained therein against the inner wall of the rotating cylinder. When in use the surfer is positioned in the cylinder on the up side of the water flow. That is, the surfer is facing in the opposite direction of the water flow and the rotation of the cylinder.

Thus, the present invention has for an important object to provide a wave-generating apparatus that creates a continuous simulated ocean-type wave that will allow one to participate in body-surfing, boogie-boarding and/or surfboarding.

Another object of the present invention is to provide wave generating apparatus that is formed having an elongated tubular structure that is defined by a horizontally positioned cylinder supported in a cradle for rotation therein. The opposite end portions of the cylinder are arranged with outer annular vertical walls or partitions that allow a given amount of water to be contained within the cylinder so that it can be rotated at a speed great enough to cause the water to be forced against the inner annular wall of the cylinder by the centrifugal force established by the rotational speed of the cylinder so as to allow the water to define an elongated water tunnel.

Still another object of the present invention is to provide a wave-generating apparatus of this type wherein the rotating cylinder creates a cylindrical-shaped wall of water of approximately two to three feet thick that defines a continuous tube of water within the horizontally disposed rotating cylinder.

A further object of the present invention is to provide an apparatus of this character wherein the rotating cylindrical wall of water approximates a natural ocean wave in shape and velocity, except it would be continuous; that is, it would have a continuous "break" and not come to an end as a natural wave does.

It is a further object of the invention to provide a wave generator of this character that is simply structured and has relatively few operating parts.

A still further object of the invention is to provide a wave-generating apparatus that can be used both as a sporting and an amusement device which is relatively inexpensive to manufacture, and that is easy to service and maintain.

Yet another object of the invention is to provide a wave generating apparatus of the character that allows a person to enter the tunnel of flowing water and experience the sensation of surfing, boogie-boarding or body-surfing, and to further allow the user thereof to ride the wave indefinitely as the wave continuously breaks as the cylinder rotates about its horizontal axis.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

With the above and related objects in view, the invention consists in the details of construction and combination of parts, as will be more fully understood from the following description, when read in conjunction with the accompanying drawings and numbered parts.

DESCRIPTION OF THE PREFERRED EMBODIMENT

Figure 1:
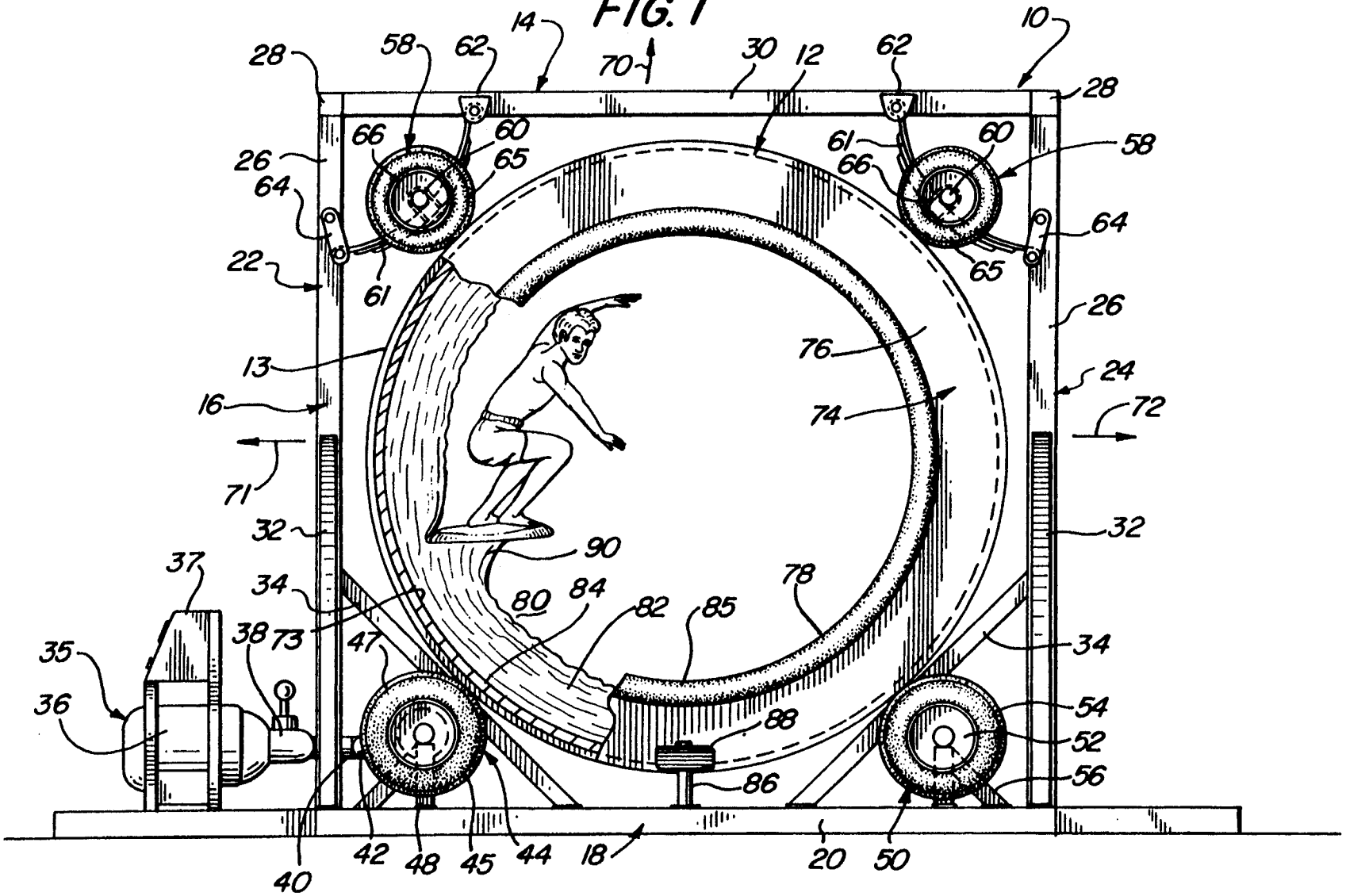
FIG. 1 is a side-elevational view of the present invention showing a portion of the end wall of the cylinder broken away and a surfer riding a wave on the clockwise flow of the water.

The present invention defines a continuous wave-producing apparatus, generally indicated at 10, comprising an elongated tube 12 defined by a horizontally positioned, elongated cylinder housing 13 cradled in a suitable carriage support means, indicated generally at 14. The carriage support means 14 comprises a vertical carriage frame structure, indicated at 16 that includes a plurality of wheels mounted to the carriage frame structure which is formed having a support base frame 18 comprising a plurality of steel tube members 20 that together define an enlarged rectangular base of a suitable size to support the horizontally disposed cylinder 13 within a vertical carriage frame 16, which comprises two oppositely disposed upright frame sections 22 and 24, respectively. Each upright frame section 22 and 24 is defined by a pair of spaced-apart, vertically positioned, tubular post members 26 that are fixedly attached at their lower ends to the base frame 18 and at their upper ends to each other by a cross tie member 28, as illustrated in FIG. 2 of the drawings. The two frame sections are secured together by means of a pair of spaced-apart; longitudinal, tubular beams 30, as seen in FIG. 1, whereby this arrangement defines an upright carriage frame 16 reinforced by angularly disposed strut members 32 and 34, as illustrated in both FIGS. 1 and 2.

In order to provide a positive rotation for the cylinder a drive means, designated at 35, is mounted to one side of the base frame 18. This means may include either a gas engine or an electric motor 36 that is operated by control means 37. Preferably, however, a suitable commercial automotive, hydraulic, three-speed transmission and torque converter 38 would be employed, and would include a necessary drive shaft 40 and a universal joint, such as indicated at 42 in FIG. 1.

Attached to the drive means 36 is a dual-axle drive assembly 44 that is operably mounted to base frame 18 and positioned thereon to transmit rotational movement to the cylinder. The drive means is transferred to the rotatable cylinder by means of two sets of dual-engaging wheels 45 mounted on both ends of an axle 46 which is attached to base frame 18 by means of axle-support leg members 48, so that tires 47 of wheels 45 engage drive rings which also define reinforcement girdles fixedly mounted over the outer surface of cylinder 12.

Figure 2:
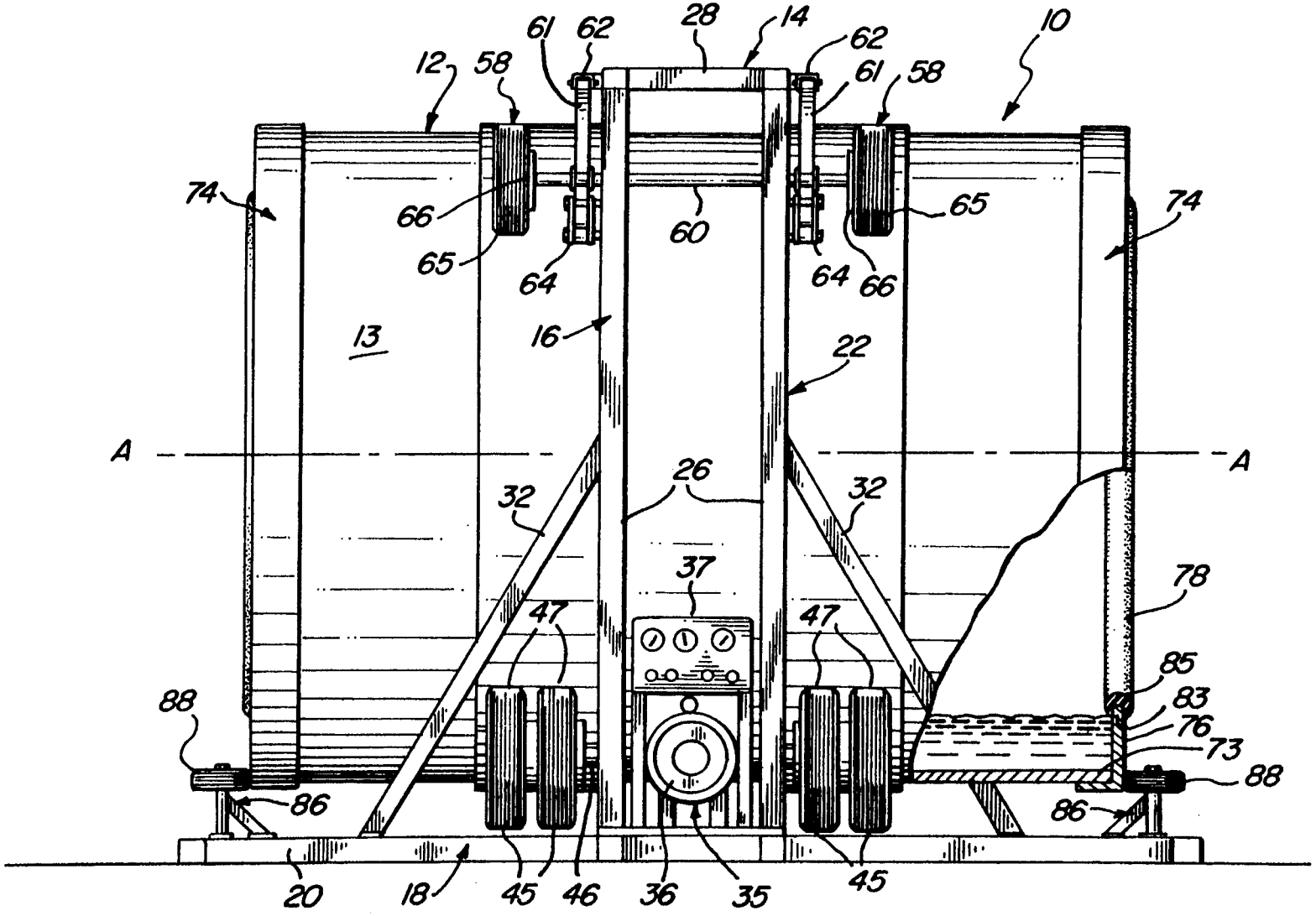
FIG. 2 is a front-elevational view of the present invention with the lower edge thereof broken away to illustrate the position of the water relative to the height of the end wall of the cylinder.

Positioned on the opposite side of cylinder 12 is a second rear axle drive assembly 50 which is also provided with two sets of engaging wheels 52 that include traction means such as tires 54, all of which are operably mounted to a second axle-support leg means 56, as seen in FIG. 1.

Mounted between cross beams 30 and upright frame sections 26 are 2 biased axle assemblies, designated at 58, Each assembly 58 comprises an axle 60 mounted to the vertical carriage frame structure 16 by means of leaf springs 61 that are respectively attached to frame section 26 and cross beams 30 by brackets 62 and 64. Tires 65 of wheels 66 are operably mounted on axles 60 with an engaging force provided by leaf springs 61 which define stabilizing means for the rotating cylinder 13. Accordingly, the stabilizing means holds cylinder 13 in a restricted and controlled horizontal position, thereby preventing excessive sideward and upward movements in the directions as indicated by respective arrows 70, 71 and 72.

The open ends 73 of the cylinder are each provided with a cap member 74 that is defined by an annular ring or wall 76 having an access opening 78, whereby the cap members establish a tubular reservoir 80. When water 82 is stored inside the cylinder reservoir during the spinning of cylinder 13 a centrifugal force is imparted to the water therein, causing the water to be pulled outwardly against the inner surface of cylindrical wall 84 of the tubular reservoir 80, as illustrated in FIG. 1. A padded ring 85 is placed over the inner annular edge 83 of wall 76 to protect the person that uses the apparatus.

To prevent longitudinal movement of cylinder along its axis A—A there is provided a restraining means 86 positioned at each end of the tube. The restraining means comprises a small wheel having a tire or bumper 88 mounted thereon for direct engagement with annular wall 76 of end cap member 74.

To fill reservoir 80 with water the cylinder should be rotating at a speed substantial enough to create a centrifugal force about its axis. The preferred speed is approximately eight to ten miles per hour or at least twenty-five rotations per minute. The rotational speed will change according to the surfing experience of the person using the wave forming apparatus.

It is contemplated that the cylinder will be approximately twelve to twenty-five feet in length and have an inner diameter of between twelve to fifteen feet. The access opening 78 of each end wall 76 of cap ends 74 is approximately nine feet in diameter. Wall 76 should have a height sufficient enough to allow reservoir 80 of cylinder 13 to hold between one to two feet of water. Thus, the centrifugal force of the spinning tube creates the large rotating cylindrical shape of the wall of water 82 that approximates a natural but continuous ocean wave in shape and velocity. That is, waves 90, as indicated in FIG. 1, would not "break" or come to an end, as that of a natural wave, until the cylinder stops rotating.

What I claim is:

1. A wave-generating apparatus, wherein a continuous wave is formed suitable for various surfriding sports including surfing, boogie-boarding and bodysurfing, said apparatus comprising:

a carriage-support means having a carriage frame structure including a base frame on which said carriage frame structure is mounted;

an elongated tube rotatably cradled in said carriage support means and having oppositely disposed open ends;

a cap member mounted over each of said open ends of said tube and including an access opening;

a reservoir formed in said tube by said cap members to hold a given amount of water within said tube during the rotation thereof;

means for rotatably supporting said tube in a horizontal position within said carriage support means; and drive means for rotating said tube to create a centrifugal force, wherein the water is forced outwardly to define a cylindrical wall of water about the interior surface of said tube, whereby a continuous wave is formed in the upwardly rotating side of said wall of water.

2. A wave-generating apparatus as recited in claim 1, wherein said tube is defined by a horizontally positioned cylindrical housing, and wherein said cap members are each formed with an annular wall to define the depth of said reservoir.

3. A wave-generating apparatus as recited in claim 2, wherein said means for rotatably supporting said tube in a horizontal position within said carriage support means comprises a plurality of wheels mounted to said carriage frame structure and said base frame; and wherein said wheels are positioned for engagement with said cylindrical housing.

4. A wave-generating apparatus as recited in claim 3, wherein said plurality of wheels includes:

a first dual-axle drive assembly mounted to said base frame adjacent one side of said cylindrical housing, a pair of said wheels being mounted at each end of said first dual axle drive assembly, and said dual-axle drive assembly being operably connected to said drive means; and a second dual-axle drive assembly mounted to said base frame adjacent the opposite side of said cylindrical housing, a pair of said wheels being mounted at each end of said second dual-axle drive assembly.

5. A wave-generating apparatus as recited in claim 4, including first and second spring-biased axle assemblies, each having wheels mounted thereon, and wherein said first and second spring-biased axle assemblies are mounted on said carriage frame structure and positioned to engage said cylinder housing on opposite sides thereof.

6. A wave-generating apparatus as recited in claim 5, wherein all of said wheels include traction means for frictional engagement with said cylindrical housing.

7. A wave-generating apparatus as recited in claim 6, wherein said traction means is defined by tires.

8. A wave-generating apparatus as recited in claim 7, wherein said apparatus includes restraining means mounted on said base frame to engage each of said cap members, thereby restraining movement of said cylinder housing along the longitudinal axis thereof.

9. A wave-generating apparatus as recited in claim 8, wherein said drive means comprises a motor, a transmission and a torque converter.

* * * * *